United States Patent [19]

Hyatt, Jr. et al.

[11] Patent Number: 4,998,952

[45] Date of Patent: Mar. 12, 1991

[54] KEY FOR ELECTRONIC AND MECHANICAL LOCKS

[75] Inventors: Richard G. Hyatt, Jr.; Charles E. Hall, both of Salem, Va.

[73] Assignee: Medeco Security Locks, Inc., Salem, Va.

[21] Appl. No.: 487,109

[22] Filed: Mar. 2, 1990

[51] Int. Cl.[5] ..... E05B 19/04

[52] U.S. Cl. ..... 70/395; 70/408

[58] Field of Search ..... 70/395, 408, 277, 278, 70/279

[56] References Cited

U.S. PATENT DOCUMENTS

| | | | |
|---|---|---|---|
| 3,579,183 | 5/1971 | Lipschutz | 70/395 |
| 3,660,624 | 5/1972 | Bell | 70/388 |
| 4,562,712 | 1/1986 | Wolter | 70/456 R |
| 4,663,952 | 5/1987 | Gelhard | 70/278 |
| 4,726,205 | 2/1988 | Allerdist | 70/395 |
| 4,858,453 | 8/1989 | Namazue | 70/408 |

FOREIGN PATENT DOCUMENTS

| | | | |
|---|---|---|---|
| 2155988 | 10/1985 | United Kingdom | 70/395 |

*Primary Examiner*—Robert L. Wolfe

*Attorney, Agent, or Firm*—Bernard, Rothwell & Brown

[57] ABSTRACT

A hybrid key for operating both electronic and mechanical locks has the electrical components in a separate and removable housing which is normally secured to the bow portion of the key blade but may be removed, the disclosed means for securing the electrical housing to the key bow is via a configuration including grooves in the housing, a hook portion on the key bow, and holes through the housing and bow at a single point for rivet securing means.

7 Claims, 1 Drawing Sheet

KEY FOR ELECTRONIC AND MECHANICAL LOCKS

FIELD OF THE INVENTION

This invention relates to improvements in hybrid keys, that is a key of the type which can operate both electrical/electronic and mechanical locks, and particularly to such key in which the electrical/electronic lock portion is removably secured to the portion of the key which operates the mechanical lock.

BACKGROUND OF THE PRIOR ART

Numerous sophisticated locking systems utilize both mechanical locks and electrical or electronically operated locks. As an example, a building entrance may have an electronic controlled lock mechanism while the individual doors in the building have mechanical locks. Persons with authorized access to an individual door would have a hybrid key having one portion to operate the electronic lock and another portion to operate the particular mechanical door lock. For example, the electronic portion would provide access to the perimeter doors of a building while the mechanical lock would provide access only to the individual's office. This is only one of a number of possibilities and circumstances where hybrid locks and keys are or could be used.

The concept of a single key for operating both mechanical and electrical locks has been known for approximately 20 years, see U.S. Pat. No. 3,660,624 granted May 2, 1972. More recent patents showing electronic keys and locks therefor include U.S. Pat. Nos. 4,438,426 granted Mar. 20, 1984; 4,697,171 granted Sept. 29, 1987; and 4,712,398 granted Dec. 15, 1987.

The keys for operating electrical/electronic locks are commonly quite expensive due to the circuitry that is required to be carried in the key. If the key is only an electronic key without any mechanical operation and a person loses his key, the electronics of the system could be changed without great expense to prevent compromise of the lock and a loss of security. Also, if there is a hybrid key including both electronic and mechanical portions, and a person loses the key, the mechanical lock could be changed by changing the mechanical lock cylinder, and if the electronic and mechanical portions of the key are integral, this involves discarding, i.e., throwing away, the very expensive electronic portion of the key.

There appears to be a need in the art for a hybrid mechanical/electronic key in which the expensive electronic component can be easily separable from but usually rigidly secured to the mechanical components so that if keys need to be replaced, the mechanical component only can be replaced while the electrical or electronic component of the key can be maintained by removing from one key frame and placing on another.

SUMMARY OF THE INVENTION

This invention provides a hybrid key for operating both electronic and mechanical locks, the mechanical portion of the key includes a key blade integral with a key bow frame and the electronic portion of the key includes an electronic circuit within a housing. The housing is removably secured to the key bow frame so that if desired, it may be separated from the frame and reused. The electronic housing and key bow frame are held together by a single rivet extending through a hole in housing flanges and the frame together with a hook arrangement on the key bow frame cooperating with an indentation in the housing. The housing has contacts on the face of the key for contacting an electronic lock. The mechanical key blade may have bits or other configurations for operating a mechanical lock or the blade may be used simply as a guide for guiding the electronic key into contact with a detector/reader.

DETAILED DESCRIPTION OF THE PREFERRED EMBODIMENT

Figure 1:
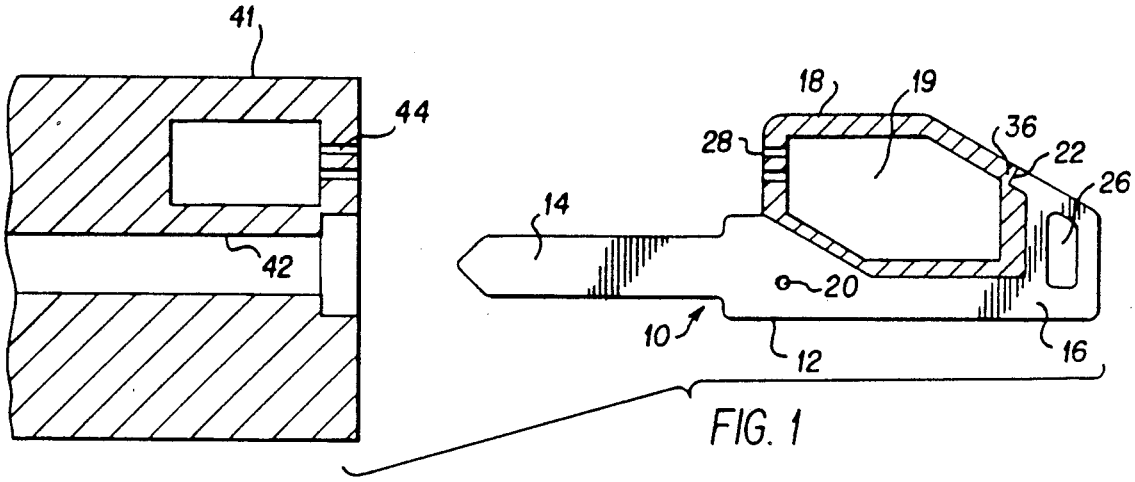
FIG. 1 is a side elevation view of the hybrid key and electronic lock receptacle with a portion of the electronic housing removed and another portion showing in section.
Figure 2:
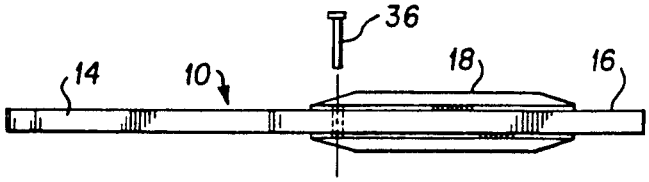
FIG. 2 is a top elevation view.
Figure 4:
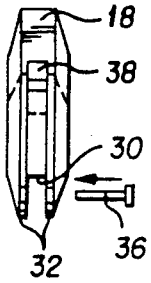
FIG. 4 is a rear end elevation of the grooved electronic housing.

A hybrid key 10 includes a mechanical key portion 12 having a key blade portion 14 and a key bow portion 16.

A housing 18 contains a molded-in circuit board 19 with memory logic circuit or the like for cooperating with an electrical or electronic lock as is known in the art. Housing 18 is removably secured to the bow portion of the key.

More particularly, the bow portion 16 of the key includes a hole 20 and an extension 22 which acts as a hook. The bow portion 16 is recessed or cut at 24 to accommodate the housing. The bow portion may have an opening 26 for allowing the key to be held on a user's key chain.

The housing 18 has contacts 28 on its forward end for contacting an electronic detector and has a cutout groove 30 corresponding to the configuration 24 of the key bow. The groove 30 leaves flanges 32 on both sides of the housing for fitting over the sides of the key bow. A hole 34 is provided in the forward corner of the flanges 32 at the same location as hole 20 when housing 18 is assembled onto the key blade. A rivet 36 or other suitable semi-permanent securing means extends through the holes 20 and 34 when the housing 18 is assembled on the key blade in order to maintain the same in its assembled position. The back portion of the housing 18 has a cutout portion 38 for accommodating the hook portion 22 of the key bow to assist in locking the housing in place.

Figure 3:
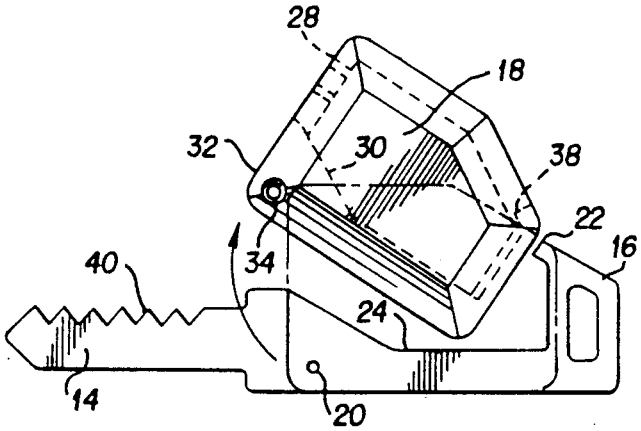
FIG. 3 is a side elevation view illustrating the assembly of the electronic and mechanical portions of the key.

The key blade may be blank as shown in FIG. 1 in which case the key is used only as an electronic key, however, preferably and usually, the key will be provided with bits 40 or other configurations as shown in FIG. 3 in order to operate a mechanical lock as well as an electronic lock.

FIG. 1 shows the operation of an electronic lock 41 in which the key is inserted into a keyway 42 positioned so that circuit connectors 44 located adjacent the keyway contact the connectors 28 of the circuit board 19 to cause the electronic lock to operate. If the key blade is cut with bits as in FIG. 3, the same operation is utilized with regard to the electronic lock, that is, the key blade 14 goes into the keyway 42 but the bits 40 operate nothing, the keyway is for guidance. For operating a mechanical lock, the key blade operates as is well known in the art, see, for example, U.S. Pat. No. 4,635,455 granted Jan. 13, 1987 to Medeco Security Locks, Inc.

which would be one possible configuration of the lock and key blades for mechanical locks.

In operation, users of a locking system having both electronic and mechanical locks would be provided with keys. If the key for the mechanical lock needed replacement, for example, if the key were lost and the mechanical lock replaced, and the electronic key did not need replacement as the circuit could be adjusted, the expensive electronic circuit portion of the key need not be discarded, as such could be taken off of one key by removing the rivet and the electronic housing could be used on another key. Because the electronic housing including the electronics are many times more expensive than the mechanical portion of the key, such provides great flexibility and significant savings.

Obvious modifications may be made within the spirit and scope of the invention as defined in the claims. For example, differing arrangements may be provided to releasably securing the electronic housing to the key bow frame, e.g. friction arrangements, snap fits, and screw attachments.

We claim:

1. A key for both electronic and mechanical locks, the key having a key bow, a key blade integral with and extending from the key bow, the key blade having a capability of being configured to operate a mechanical lock, and an electronic circuit means carried by the key bow for operating an electronically activated lock, with improvements comprising;

a completely separate and removable housing containing the electronic circuit means, means for securing such housing to the key bow to allow removal of such housing to separate the housing and thereby allowing such circuit to be placed on another key.

2. A key as defined in claim 1 wherein the means for securing is a single rivet means.

3. A key as in claim 2 wherein there is a hole through the housing and the key bow for the single rivet securing means.

4. A key as in claim 3 wherein the housing has side flanges to fit over a portion of the sides of the key bow.

5. A key for both electronic and mechanical locks, the key having a key bow, a key blade integral with and extending from the key bow, the key blade having a capability of being configured to operate a mechanical lock, and an electronic circuit means carried by the key bow for operating an electronically activated lock, with improvement comprising:

a separate and removable housing containing the electronic circuit means, the housing having side flanges to fit over a portion of the sides of the key bow, a means for securing the housing to the key bow to allow removal of such housing to separate the housing and thereby allowing such circuit to be placed on another key, and wherein the key bow has a hook portion to hook into the housing and assist in retaining the housing on the key bow.

6. A key as defined in claim 5 wherein the housing has contacts at one end to operate contacts of an electronic lock when the key blade is inserted into a portion of an electrical lock.

7. A hybrid key for operating both electronic and mechanical locks, the key comprising; a key bow frame portion, an extending key blade portion integral with and extending from the key bow frame portion, the blade portion being capable of fitting into a keyway of a mechanical lock and into a guide passage keyway for an electronic lock and being capable of being configured to operate the mechanical lock, a housing, an electronic memory logic circuit means carried within the housing, and hook and single rivet means cooperating between the housing and the bow frame for removably securing the housing to the key bow frame and to allow the housing to be removed from the key bow frame.

* * * * *